US008497440B2

(12) United States Patent
Kitahara

(10) Patent No.: US 8,497,440 B2
(45) Date of Patent: Jul. 30, 2013

(54) PUSH SWITCH

(75) Inventor: Takahisa Kitahara, Isesaki (JP)

(73) Assignee: Tokyo Parts Industrial Co., Ltd., Gunma-Ken (JP)

( * ) Notice: Subject to any disclaimer, the term of this patent is extended or adjusted under 35 U.S.C. 154(b) by 258 days.

(21) Appl. No.: 13/065,847

(22) Filed: Mar. 31, 2011

(65) Prior Publication Data

US 2011/0284351 A1 Nov. 24, 2011

(30) Foreign Application Priority Data

May 21, 2010 (JP) ..... 2010-117153

(51) Int. Cl.
*H01H 13/06* (2006.01)

(52) U.S. Cl.
USPC ..... 200/302.2

(58) Field of Classification Search
USPC ..... 200/302.2, 302.1, 302.3, 341
See application file for complete search history.

(56) References Cited

U.S. PATENT DOCUMENTS 5,089,671 A * 2/1992 Ranetkins ..... 200/302.2
6,768,070 B2 * 7/2004 Lewison et al. ..... 200/302.2
2010/0230262 A1 * 9/2010 Devine ..... 200/302.2

FOREIGN PATENT DOCUMENTS

JP 2005-203315 7/2005

* cited by examiner

*Primary Examiner* — Felix O Figueroa
(74) *Attorney, Agent, or Firm* — Jordan and Hamburg LLP

(57) ABSTRACT

A flexible button of a push switch includes a peripheral side wall having an opening at the bottom. A switch board is fitted in the opening of the peripheral side wall. A switch is provided on the switch board. A tubular case is fixed in place around the peripheral side wall. A stopper is disposed under the switch board, and latched on the inner face of the case. Filler fills the underside of the switch board, and fills at least an area that includes the entire peripheral length of the bottom periphery of the switch board and the bottom-end inner peripheral face of the peripheral side wall.

2 Claims, 6 Drawing Sheets

PRIOR ART

PUSH SWITCH

BACKGROUND OF THE INVENTION

1. Field of the Invention

The present invention relates to a waterproof push switch.

2. Description of the Related Art

In terms of waterproof push switches, for example, Japanese Patent Laid Open Publication No. 2005-203315 describes a push switch comprising a push button 103, a board 110, a dome (switch) 111, a back cover (stopper) 113 and a tubular case 101, as shown in FIG. 6.

At the edge of an opening in the case 101, an annular rib 105 is provided, which is bent towards the interior of the opening, and a groove 106 is provided between this annular rib 105 and the internal circumference of the case.

A flange 108 is provided on the outer circumference of the push button 103, and a protrusion 107 is provided on the flange 108, which fits into the groove 106.

When the push button 103 is arranged in the case, the protrusion 107 on the push button 103 fits into the groove 106 in the case. The board 110 is inserted by way of the lower opening of the case 101. This board 110 is disposed in contact with the bottom of the flange 108 on the push button 103, and is fixed in place by the back cover 113.

With the push switch in FIG. 6, if a drop of water adheres to the top of the push switch, it is possible that, via the groove 106, the drop of water will pass between the flange 108 and the board 110, and ingress to the interior of the push button 103. Furthermore, if a drop of water adheres to the bottom of the push switch, it is possible that the drop of water will move along the inner face of the case 101, pass between the flange 108 on the push button 103 and the board 110, and ingress to the interior of the push button 103.

Consequently, with the push switch in FIG. 6, in order to keep the interior of the push button 103 waterproof, it is necessary to apply potting materials (fillers) 109, 114 in two places: on the top of the annular rib 105 that is provided on the case, and at the bottom opening of the case. This requires numerous potting material application steps, making the production characteristics extremely poor.

Furthermore, because the curing times for potting materials are generally very long, requiring approximately one day, and because a drying space must be provided, there was a demand for a reduction in potting material application steps.

SUMMARY OF THE INVENTION

Thus, an object of the present invention is to provide a push switch that is capable of maintaining the interior of the push button waterproof, and with which it is possible to improve production characteristics by reducing the potting material application steps.

In order to achieve the aforementioned objective, the push switch of the present invention comprises: a flexible button 10 comprising a top wall 11 and a peripheral side wall 14 having an opening at the bottom; a switch board 30 that is fitted in the opening of the peripheral side wall 14; a switch 40 provided on the switch board 30; a tubular case 50 fixed in place around the peripheral side wall 14; a stopper 60 that is disposed under the switch board 30, and latched on the inner face of the case 50; and filler 70 that fills the underside of the switch board 30, and fills at least an area that includes the entire circumferential length of the bottom periphery 31 of the switch board 30 and the bottom-end inner peripheral face 17 of the peripheral side wall 14.

In the push switch of the present invention described above, the stopper 60 preferably comprises a central portion 61 and extending portions 63, 64 that extend outwards from the central portion 61 and latch on the inner face of the case 50; and the filler (70) preferably fills a space between the bottom periphery 31 of the switch board 30 and the extending portions 63, 64 of the stopper 60.

Furthermore, in the push switch of the present invention described above, the case 50 preferably has guide grooves 52 on the inner faces thereof; and the extending portions 63, 64 of the stopper 60 preferably engage in the guide grooves 52.

According to the present invention, the switch board 30 is fitted in the opening of the peripheral side wall 14 of the button 10 and the filler 70 fills an area that includes the entire peripheral length of the bottom periphery 31 of the switch board 30 and the bottom-end inner peripheral face 17 of the peripheral side wall 14, whereby it is possible to prevent drops of water from ingressing into the interior of the button, without applying filler at the top of the push switch, and thus maintain the waterproofness of the interior of the button while reducing the filler application steps, whereby production characteristics are improved.

DESCRIPTION OF THE PREFERRED EMBODIMENTS

Figure 1A:
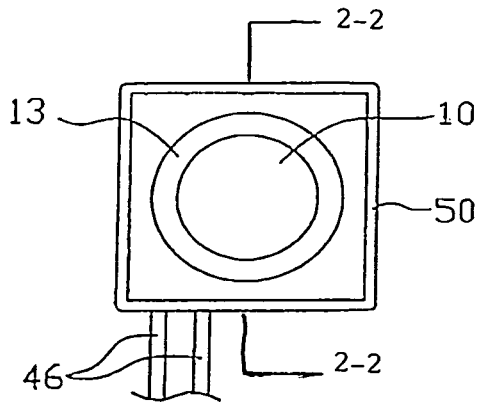
FIG. 1 shows a push switch in one mode of embodiment of the present invention, wherein FIG. 1(*a*) is a plan view and FIG. 1(*b*) is a perspective view.
Figure 1B:
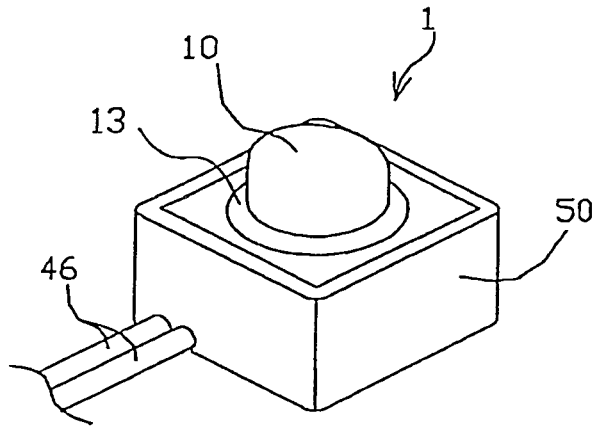

Hereafter, a mode of embodiment of the present invention is illustratively described with reference to the drawings.

In FIGS. 1 to 4, the push switch 1 in this mode of embodiment is mounted in an opening hole in a door handle device for a vehicle, which is not shown in the drawing. A button 10 of the push switch 1 is mounted in the opening hole of the door handle device, so as to be exposed to the exterior. The door can be locked or unlocked by pressing the button 10 with a finger or the like.

The push switch 1 comprises the button 10, a switch board 30, a switch 40, a case 50, a stopper 60, and filler 70.

Figure 2:
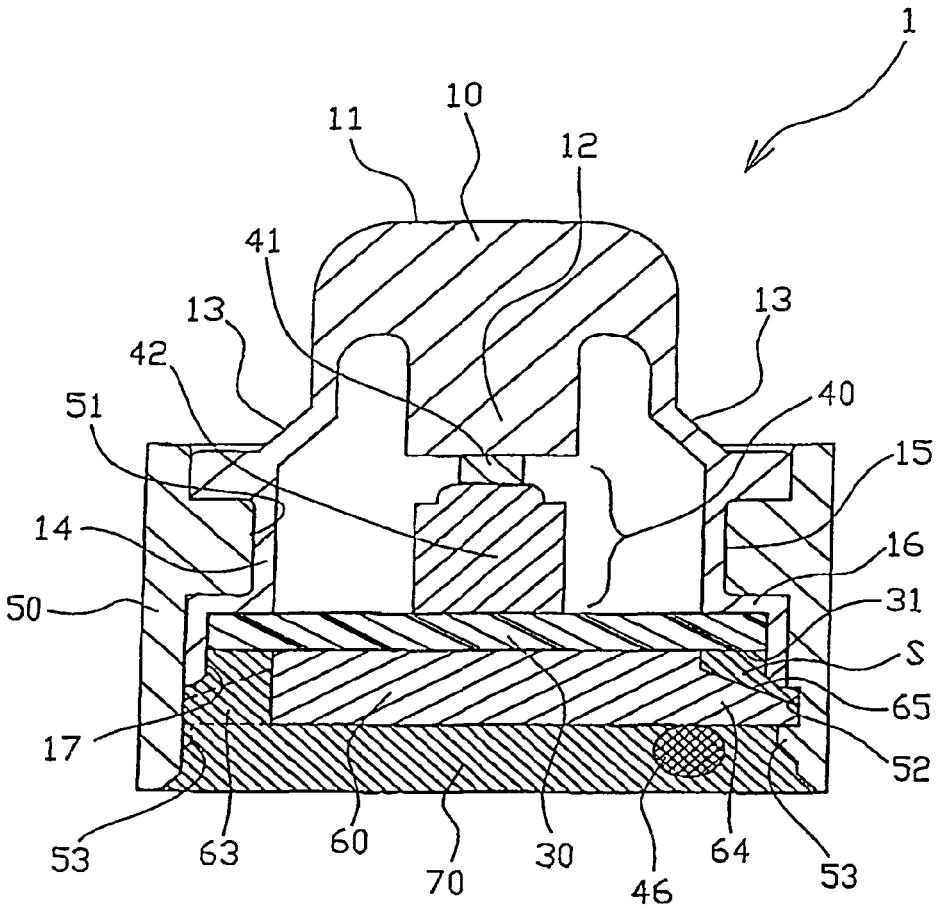
FIG. 2 is a sectional view along the line A-A in FIG. 1(*a*).

As shown in FIG. 2, the button 10 is integrally formed from flexible resin and comprises: a top wall 11, which protrudes to the exterior of the door from the opening hole in the door handle device; a substantially cylindrical pushing part 12, which protrudes downwards from the top wall 11; a thin, elastically deformable buckling part 13, which tapers outward in the downward direction from the top wall 11 and surrounds the pushing part 12; and a peripheral side wall 14, which extends downwards from the lower edge of the buckling part 13, and has an opening at the bottom.

A groove 15 is provided around the entire outer periphery of this peripheral side wall 14. Furthermore, a stepped portion 16 is provided on the inside of this peripheral side wall 14.

The switch base board 30 is made from an insulating board, and is provided with a predetermined wiring pattern (not shown in the drawing) and through-holes 44.

The switch board 30 is fitted into the opening of the peripheral side wall 14 of the button 10 and the peripheral portion of the top face of the switch board 30 abuts the stepped portion 16.

The height from the lower edge of the peripheral side wall 14 to the stepped portion 16 is established at greater than the thickness of the switch board 30, so that the bottom end of the peripheral side wall 14 projects below the switch board 30.

A switch 40 is disposed on the switch board 30. The switch 40 comprises an actuation part 41 and a main body part 42. Terminals 43 of the switch 40 are inserted into the through holes 44, which are provided in the switch board 30, and connected to the wiring pattern (not shown in the drawing) with solder 45 (see FIG. 4).

Lead wires 46 are electrically connected to the terminals 43 via the wiring pattern (not shown in the drawing) on the switch board 30. Signals from the switch 40 are transmitted to the exterior via these lead wires 46.

The actuation part 41 of the switch 40 is biased upward as seen in FIG. 2 and serves to turn the switch 40 on and off. When pressed downwards as seen in FIG. 2, the actuation part 41 produces a click sensation, and produces a conducting state between contacts that are not shown in the drawing. When the pressing force is released from the actuation part 41, the actuation part 41 returns to its original state and a non-conductive state is produced between the contacts.

The case 50 is formed from a hard resin in a substantially square tubular shape. The case 50 has an inner flange 51, which protrudes inward from the inner face of the case 50 along the entire internal periphery thereof. The inner flange 51 fits into a groove 15 in the peripheral side wall 14 of the button 10.

Guide grooves 52 are provided on the inner face of the case 50, below the inner flange 51. The tips of extending portions 63, 64 of a stopper 60, which will be described hereafter, engage in the guide grooves 52.

The guide grooves 52 are provided oriented upwards from the bottom opening of the case 50, on the inner face of the case 50. Latching protrusions 53, which latch the tips of the extending portions 63, 64 of the stopper 60 are provided within the guide grooves 52.

Furthermore, holes 54 are provided in the case 50, and serve to guide the lead wires 46 to the exterior of the case 50.

The stopper 60 is a member that supports the switch board 30 within the case. This stopper 60 is formed from a hard resin, and is disposed under the switch board 30, so as to be latched by the latching protrusions 53 on the case 50.

When the stopper 60 is latched in the case, the upper peripheral portion of the switch board 30 presses the stepped portion 16 of the button 10 against the inner flange 51, so that the stepped portion 16 and the inner flange 51 are in close contact. Thus, even if a drop of water adheres to the top of the button 10, the drop of water will not readily ingress into the interior of the button 10.

Figure 3:
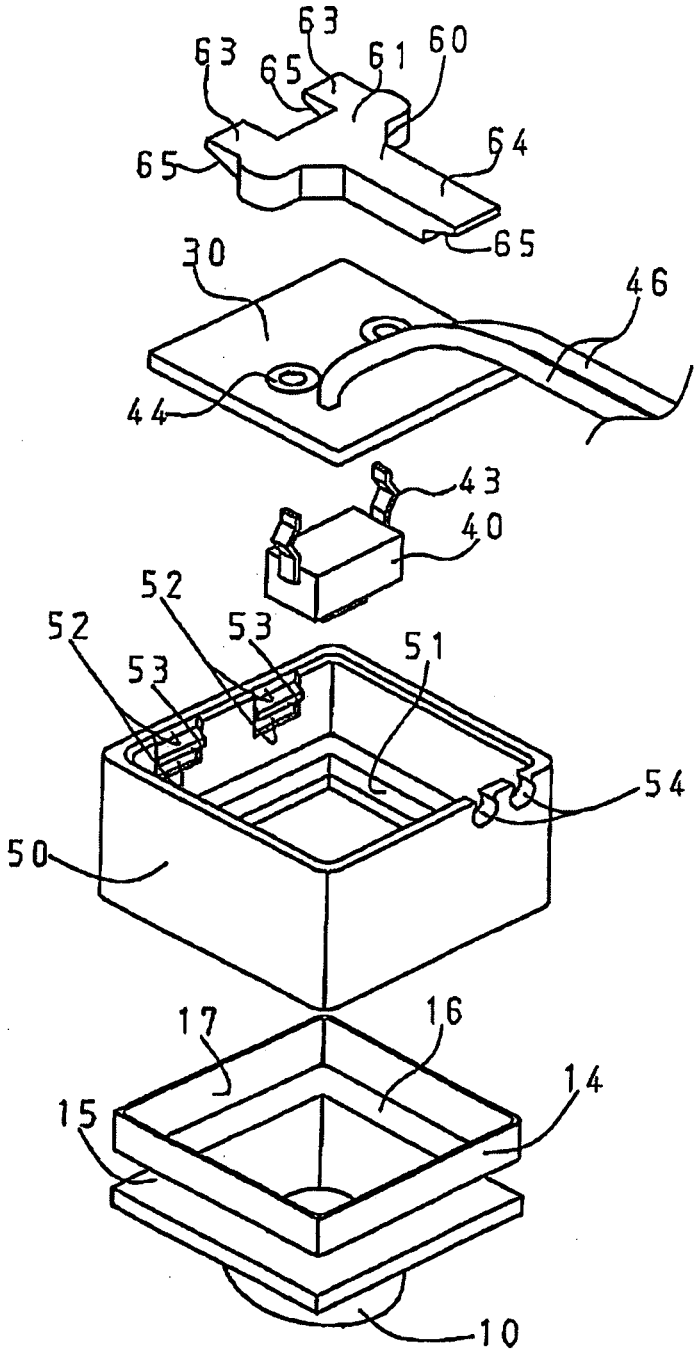
FIG. 3 is a perspective assembly view of the push switch in FIG. 1, seen from the bottom.
Figure 4:
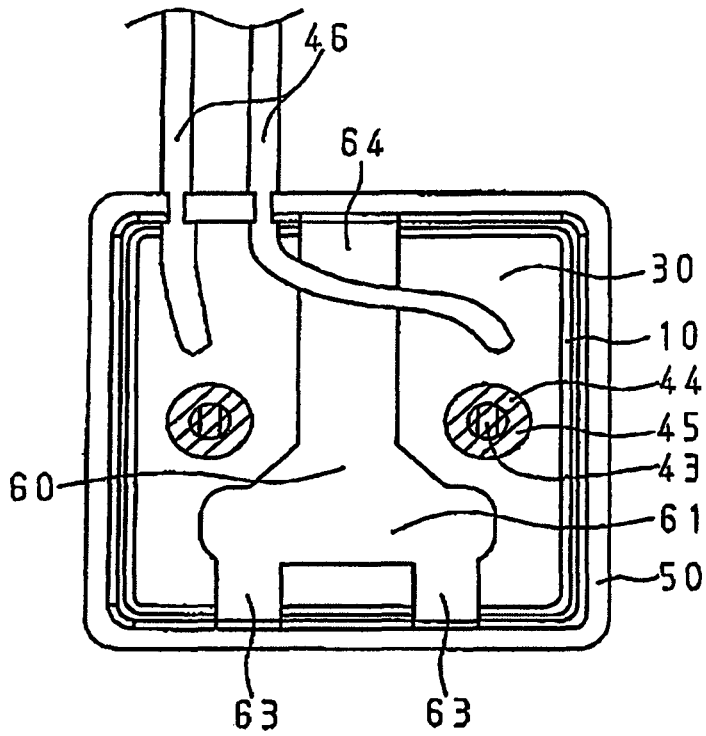
FIG. 4 is a bottom view of the push switch in FIG. 1, before applying filler.

As shown in FIG. 3 and FIG. 4, the stopper 60 in this mode of embodiment comprises an I-shaped central portion 61, two first extending portions 63, which extend, on a first side, from the two ends of the central portion 61, and a second extending portion 64, which extends, on a second side, from the center of the central portion 61.

The tips of the extending portions 63, 64 engage in the guide grooves 52 in the case 50, and latch on the latching protrusions 53 in the guide grooves 52.

The extending portions 63, 64 are formed with tapered portions 65, which narrow towards the tips, so that spaces S are provided between the extending portions 63, 64 and the bottom periphery 31 of the switch board 30 (see FIG. 2). Consequently, prior to filling with the filler 70, which is described hereafter, the bottom periphery 31 of the switch board 30 and the bottom-end inner peripheral face 17 of the peripheral side wall 14 are exposed along the entire peripheral lengths thereof.

The filler 70 serves to seal the bottom of the case 50 and, for example, a two-liquid mixture type epoxy resin or the like can be used.

This filler 70 entirely fills the space within the case under the switch board, including the aforementioned spaces S, so that the bottom-end inner peripheral face 17 of the peripheral side wall 14 and the bottom periphery 31 of the switch board 30, which were exposed in the spaces S, are filled along the entire peripheral lengths thereof.

Next, the assembly steps for the push switch 1 in this example will be briefly described with reference to FIG. 5.

Figure 5:
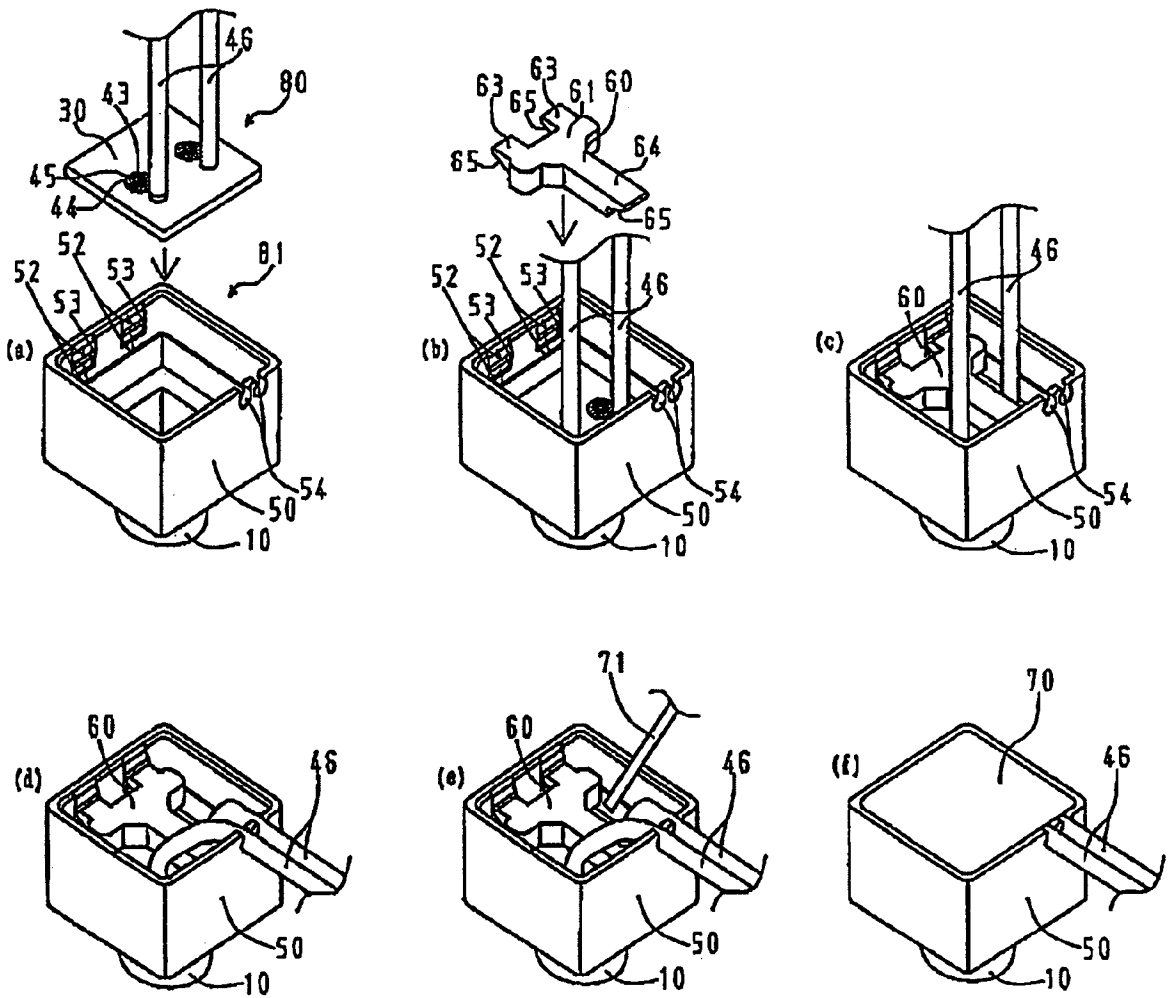
FIG. 5 is a perspective view serving to describe the assembly steps for the push switch in FIG. 1.

FIG. 5(*a*) is a perspective view of the situation prior to the switch board assembly being assembled with the case assembly. FIG. 5(*b*) is a perspective view of the situation prior to the stopper being assembled with the case assembly. FIG. 5(*c*) is a perspective view of the situation after the stopper has been assembled with the case assembly. FIG. 5(*d*) is a perspective view of the situation after the lead wires have been inserted into the lead wire holes in the case. FIG. 5(*e*) is a perspective view of filler being applied with a dispenser. FIG. 5(*f*) is a perspective view of the situation after the filler has been applied to the entire interior of the bottom opening of the case.

First, the lead wires 46 are soldered to the switch board 30, on which the switch 40 has been mounted, so as to produce the switch board assembly 80.

Next, the button 10 is disposed within the case 50, and the inner flange 51 of the case 50 is fitted in the groove 15 of the button 10 so as to produce the case assembly 81.

Next, the switch board assembly 80 is fitted in the case assembly 81.

(For the above, see FIG. 5(*a*).)

With the switch board assembly 80 fitted in the case assembly 81, as shown in FIG. 2, the bottom edge of the peripheral side wall 14 of the button 10 projects below the switch board 30 and the bottom-end inner peripheral face 17 of the peripheral side wall 14 is exposed along the entire peripheral length thereof.

Next, the stopper 60 is inserted via the bottom opening of the case 50. The stopper 60 engages in the guide grooves 52 in the case 50, and latches on the latching protrusions 53 (see FIG. 5(*b*) and (*c*)).

Next, the lead wires 46 are inserted into the lead wire holes 54 in the case 50 (see FIG. 5(*d*)).

Next, the filler 70 is applied to the bottom of the switch board 30 with a dispenser 71 (see FIG. 5(*e*)), and the space within the case 50 under the switch board is filled (see FIG. 5(*f*)).

When the filling is performed with this filler 70, because the spaces S are provided between the extending portions 63, 64 of the stopper 60 and the bottom periphery 31 of the switch board 30, as shown in FIG. 2, the filler 70 entirely fills the space within the case under the switch board, including the spaces S. Accordingly, the entire peripheral length is filled by the filler 70, including in the area that includes the bottom periphery 31 of the switch board 30 and the bottom-end inner peripheral face 17 of the peripheral side wall 14, which have been exposed within the spaces.

Then, when the filler 70 hardens, the push switch 1 is complete.

With a push switch 1 according to this mode of embodiment, which is configured as described above, when the button 10 is pressed downwards from above as seen in FIG. 2, the buckling portion 13 is elastically deformed, while pushing part 12 pushes the actuation part 41 downwards, so that the switch 40 is turned on.

When the pushing force is released from the button 10, the button 10 recovers elastically, so that the button 10 and the actuation part 41 return to their initial positions and the switch 40 is turned off, whereafter the operations can be repeated.

Furthermore, with the push switch 1 of this mode of embodiment, the switch board 30 is fitted into the opening of the peripheral side wall 14 of the button 10, and the region including the entire peripheral length of the bottom periphery 31 of the switch board 30 and the bottom-end inner peripheral face 17 of the peripheral side wall 14 is filled with the filler 70. Consequently, not only is it possible to prevent ingress of water into the interior of the button 10 from the bottom of the push switch 1, even supposing that water were to pass through a gap between the inner flange 51 and the groove 15 from the top of the push switch 1, ingress of water into the interior of the push switch 10 can be prevented.

Figure 6:
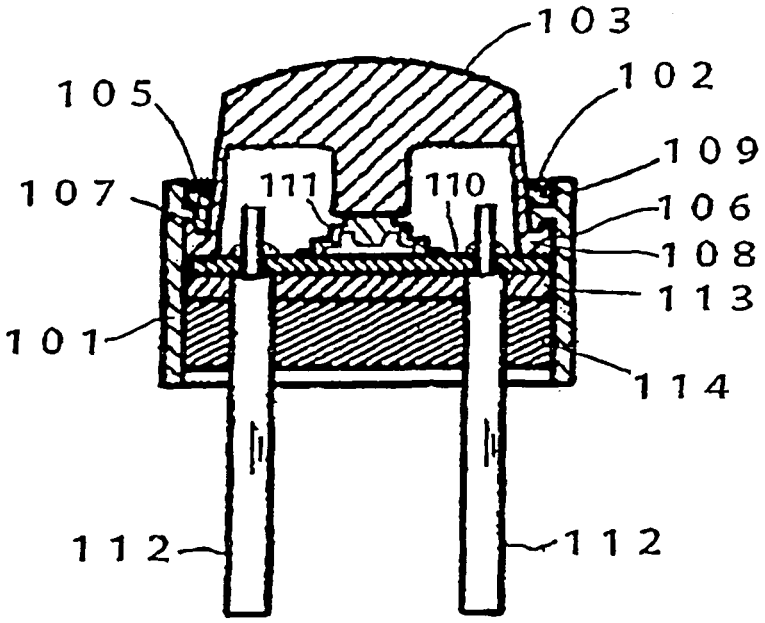
FIG. 6 is a sectional view of a conventional push switch.

Accordingly, with the push switch 1 of this mode of embodiment, it is not necessary to apply filler in two places, at the top and the bottom of the push switch, as in the conventional example shown in FIG. 6. Rather, simply by applying filler from the bottom of the case, fully waterproof characteristics can be achieved, and thus the filler application steps can be reduced and the production characteristics can be improved.

Furthermore, with the push switch 1 of this mode of embodiment, the stopper 60 is disposed under the switch board 30, and is fixed in place in the case 50 by the latching protrusions 53. In this manner, the stopper 60 can fix the switch board 30 in place within the button 10, and thus the pushing force that is applied to the button 10 can be received by the stopper 60.

Furthermore, if the stopper 60 were disposed over the entire bottom face of the switch board 30, it would not be possible to fill the portions at the bottom periphery 31 of the switch board 30 and the bottom-end inner peripheral face 17 of the peripheral side wall 14 with the filler 70. But, in this mode of embodiment, spaces S are provided between the extending portions 63, 64 of the stopper 60 and the bottom periphery 31 of the switch board 30. Consequently, the region including the bottom periphery 31 of the switch board 30 and the bottom-end inner peripheral face 17 of the peripheral side wall 14 can be filled with the filler 70 over the entire peripheral length thereof, and ingress by water into the interior of the button 10 can be reliably prevented.

Furthermore, in this mode of embodiment, as shown in FIG. 4, the extending portions 63, 64 of the stopper 60 are disposed so as to avoid the four corners of the case 50, whereby the filler 70 can easily reach the four corners of the bottom-end inner peripheral face 17 of the peripheral side wall 14, and it is possible to reliably fill the region including the bottom periphery 31 of the switch board 30 and the bottom-end inner peripheral face 17 of the peripheral side wall 14 without leaving gaps.

Furthermore, if the stopper 60 is disposed so as to avoid the four corners at the interior of the case 50, there is a risk of the stopper 60 moving before the filler 70 is applied, but in this mode of embodiment, the extending portions 63, 64 of the stopper 60 engage in the guide grooves 52, which are inset from the inner face of the case 50. Consequently, the stopper 60 will not move within the case 50 after the stopper 60 is assembled with the case 50 and prior to application of the filler 70. Accordingly, it is easily possible for the filler 72 reach the region including the bottom periphery 31 of the switch board 30 and the bottom-end inner peripheral face 17 of the peripheral side wall 14 over the entire peripheral length thereof, and thus there will be no loss of waterproofness.

In the foregoing, one mode of embodiment of the present invention has been described, but the present invention is not limited to such a mode of embodiment, and maybe carried out with suitable modifications without departing from the gist thereof. Specifically, for example, the stopper 60 is not limited to a shape such as shown in FIG. 3, but rather may also be cross-shaped or H-shaped.

What is claimed is:

1. A push switch comprising:

a flexible button comprising a top wall and a peripheral side wall having an opening at a bottom of said peripheral side wall;

a switch board that is fitted in said opening of said peripheral side wall;

a switch means on said switch board;

a tubular case fixed in place around said peripheral side wall;

a stopper disposed under said switch board and latched on an inner face of said case; and filler that fills an underside of said switch board and fills at least an area that includes an entire peripheral length of a bottom periphery of said switch board and a bottom-end inner peripheral face of said peripheral side wall;

wherein said stopper comprises a central portion and an extending portion that extends outwards from said central portion and latches on the inner face of said case; and said filler fills a space between the bottom periphery of said switch board and said extending portion of said stopper.

2. The push switch according to claim 1 wherein said case has a guide groove on an inner face thereof; and said extending portion of said stopper engages in said guide groove.

* * * * *